United States Patent [19]

Boswell

[11] 4,257,383

[45] Mar. 24, 1981

[54] CRANKCASE VACUUM SYSTEM

[76] Inventor: William C. Boswell, 3942 S. Detroit, Tulsa, Okla. 74105

[21] Appl. No.: 65,132

[22] Filed: Aug. 9, 1979

[51] Int. Cl.[3] ..... F02M 25/06

[52] U.S. Cl. ..... 123/572; 123/574

[58] Field of Search ..... 123/572, 573, 574, 41.86

[56] References Cited

U.S. PATENT DOCUMENTS

| | | | |
|---|---|---|---|
| 3,338,222 | 8/1967 | Rauen | 123/572 |
| 3,820,518 | 6/1974 | Dolfi | 123/572 |
| 4,195,607 | 4/1980 | Nagasaka | 123/572 |

*Primary Examiner*—Ronald H. Lazarus

*Attorney, Agent, or Firm*—Head & Johnson

[57] ABSTRACT

An engine crankcase vacuum system wherein a check valve is interposed between the intake manifold and the fuel pump and is in open communication with the crankcase breather of the engine in order to rapidly create and maintain a vacuum in the crankcase. The crankcase vacuum greatly reduces oil migration around the piston rings and valve guides of the engine in order to reduce oil consumption, decrease contamination of the combustion chamber from oil leakage, and reduce detonation tendency. The crankcase vacuum also allows a reduction in oil ring tension which in turn reduces engine friction, resulting in a high power output and cooler running engine during operation thereof.

7 Claims, 2 Drawing Figures

CRANKCASE VACUUM SYSTEM

BACKGROUND OF THE INVENTION

1. Field of the Invention

This invention relates to improvements in engines and more particularly, but not by way of limitation, to a crankcase vacuum system for improving the overall operation of the engine.

2. Description of the Prior Art

In an internal combustion engine, or the like, a crankcase is usually bolted or otherwise secured to the engine block for encasing the crank shaft and bearings and for maintaining a supply of suitable lubricating fluid or oil for operation of the pistons, and the like. During the operation of the engine, the lubricating fluid or oil frequently leaks across the piston rings and enters the combustion chamber, which not only fouls the combustion chamber but also reduces the operating efficiency of the engine.

SUMMARY OF THE INVENTION

The present invention contemplates a novel crankcase vacuum system which has been particularly designed for overcoming the foregoing disadvantages. The novel system comprises a check valve interposed between the fuel pump and intake manifold of the engine, and in communication with the crankcase breather. When the engine is started, the normal manifold vacuum quickly evacuates the crankcase through the check valve. The manifold vacuum will pull through the check valve at any time when the intake manifold vacuum is greater than the crankcase vacuum, and this condition is particularly present when the engine is at an idling speed or when the engine is at a part throttle operating condition. The fuel pump continuously draws a vacuum, particularly in these operating conditions, since it is driven by the engine.

During higher throttle operation of the engine, and particularly at a wide open throttle operation, the manifold vacuum will drop below the crankcase vacuum. When this happens, the check valve will automatically close and prevent the communication of the manifold pressure to the crankcase. The fuel pump continues to draw a vacuum, and since the check valve is closed, this fuel pump operation maintains the crankcase vacuum.

Of course, other means of producing a vacuum in the crankcase may be interposed in the system, either in series with or parallel with the manifold, crankcase and fuel pump. In any event, the creation of the vacuum in the crankcase provides an improved oil control, reduces oil consumption, maintains a cleaner condition for the combustion chamber, reduces detonation tendency, and allows a reduction of oil ring tension for reducing engine friction and increasing power output with a cooler running engine. The novel system is simple and efficient in operation and economical of installation.

DESCRIPTION OF THE PREFERRED EMBODIMENT

Figure 1:
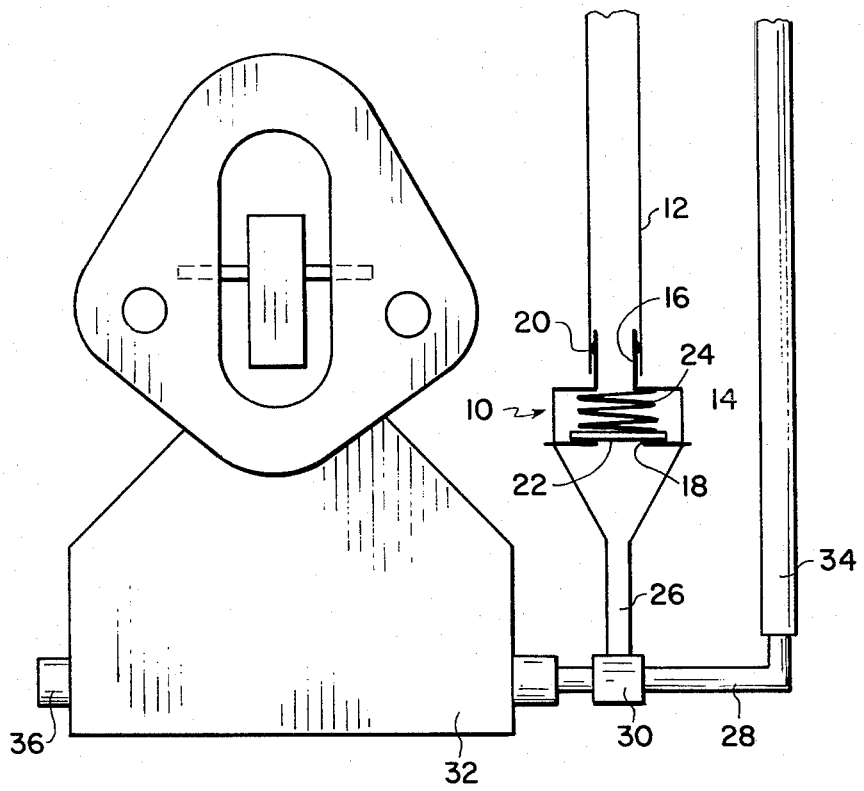
FIG. 1 is an elevational view, partly in section, illustrating a crankcase vacuum system embodying the invention and illustrating a check valve interposed between a fuel pump and an intake manifold and in communication with a crankcase breather.

Referring to the drawings in detail, and particularly FIG. 1, a crankcase vacuum system is shown which comprises a suitable check valve 10 secured to a conduit or tube 12 extending to the intake manifold (not shown) of an internal combustion engine, or the like (not shown). Whereas the valve 10 may be of any well known type, as shown herein, the valve comprises a housing 14 having an inlet port 16 provided at one end thereof and an outlet port 18 provided at the opposite end thereof. The inlet port 16 is preferably in communication with the interior of the conduit 12 and suitable sealing means 20 may be interposed between the inlet 16 and conduit 12 for precluding leakage of fluid therebetween. A closure member 22 is movably disposed in the proximity of the outlet port 18 and is yieldable retained in engagement therewith in any suitable manner, such as by a helical spring 24 anchored between the closure member 22 and the inner periphery of the housing 14. The spring member 24 maintains the closure member 22 in a normal closed position against the outlet port 18 as is well known. However, when the pressure differential acting on the closure member 22 exceeds the force of the spring 24, the closure member 22 will be moved away from the port 18 for permitting the flow of fluid therethrough as will be hereinafter set forth.

The outlet port 18 is in communication with a suitable conduit 26 which is connected with a line or conduit 28 by a suitable Tee-fitting 30, or the like, as is well known. The conduit 28 extends between the usual fuel pump 32 and a line or conduit 34 communicating with the usual crankcase breather (not shown), and in this manner the check valve inlet port 22 is in communication with both the fuel pump 32 and the interior of the crankcase for a purpose as will be hereinafter set forth. The fuel pump 32 is provided with an outlet 36 which is open to the atmosphere.

When the engine (not shown) is initially started in the usual or well known manner, a vacuum is pulled or created in the intake manifold, and this vacuum is communicated to the valve 10 through the conduit 12 and the inlet port 16. When the vacuum in the intake manifold is greater than the vacuum present within the crankcase, or in other words, when the pressure within the intake manifold is less than the pressure within the crankcase, the pressure differential acting on the closure member 22 will overcome the force of the spring 24 and move the closure member away from the port 18 whereby communication is established between the intake manifold and the interior of the crankcase. The crankcase will thus be quickly evacuated through the check valve to establish a vacuum in the crankcase. The reduced pressure thus present in the crankcase decreases oil migration around the piston rings (not shown) and valve guides, thus greatly reducing accidental passage of the lubricating fluids into the combustion chamber.

Under any conditions wherein the vacuum present in the intake manifold is greater than the vacuum within the crankcase, the communication will be established between the manifold and crankcase through the valve 10. This condition is usually present at engine idling speeds, and at part throttle conditions.

When the intake manifold vacuum drops to a point below the crankcase vacuum, the closure member 22 will be urged in a direction toward the port 18 and maintained in a closed position thereagainst by the spring 24. This precludes the communication of the manifold pressure to the crankcase, and maintains the crankcase vacuum condition since the fuel pump draws a vacuum during its entire operation and the crankcase is in communication with the fuel pump 32 through the conduits 28 and 34.

Figure 2:
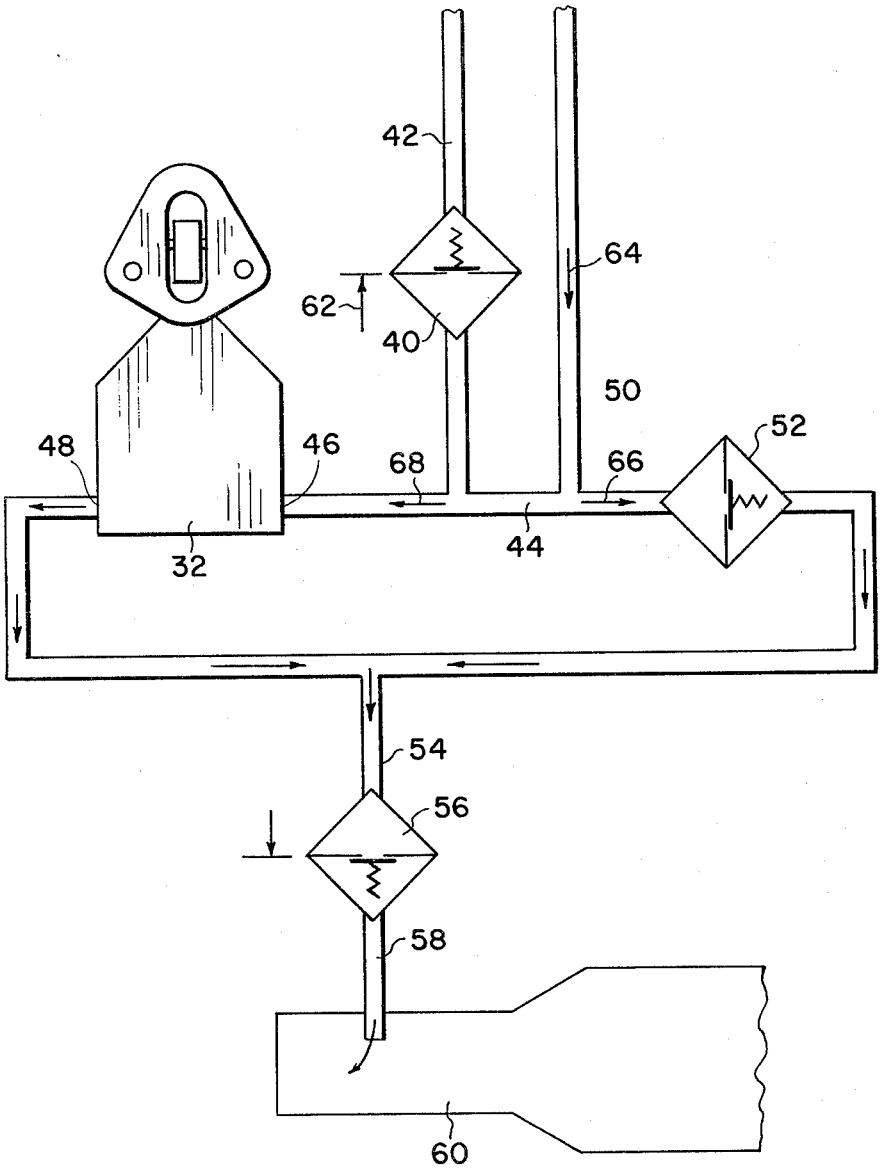
FIG. 2 is an elevational view, partly in section, of a modified crankcase vacuum system embodying the invention.

Referring now to FIG. 2, a modified crankcase vacuum system is shown wherein a first check valve 40 generally similar to the valve 10 is interposed in a suitable conduit 42 which communicates between the intake manifold (not shown) and a closed circuit conduit 44. The conduit 44 extends from the inlet port 46 of the fuel pump 32 to the outlet port 48 thereof for circulation of fluid pressure as will be hereinafter set forth. A first branch line or conduit 50 is interposed in the circuit 44 and extends into communication with the interior of the crankcase (not shown), and a second check valve 52 is interposed in the circuit 44 outboard of the conduit 50 with respect to the fuel pump 32. A second branch conduit 54 is interposed in the circuit 44 and extends into communication with a third check valve 56 which in turn opens to a pitot tube 58 which empties into the usual exhaust collector 60.

In this embodiment of the invention, fluid pressure is circulated through the fuel pump in a closed pathway through the conduit 44. However, as in the first embodiment, a vacuum is pulled in the intake manifold upon energization of the engine (not shown), which opens the valve 40 and pulls fluid pressure in the direction indicated by the arrow 62. This pulls a vacuum in the crankcase (not shown) through the conduit 50 in the direction indicated by the arrow 64. As long as the pressure within the manifold is less than the pressure in the crankcase, the valve 40 will remain open for pulling the vacuum through the conduit 50. Of course, the pressure being evacuated from the crankcase may be exhausted through the circuit 44 in the direction of either arrow 66 or 68. The pressure moving in the direction of the arrow 66 passes through the open valve 52 for movement through the open valve 56 to discharge through the pitot tube 58 into the exhaust collector 60. Of course, the outlet 48 is also in communication with the valve 56 wherein exhaust from the fuel pump 32 may pass through the valve and into the pitot tube 58 for discharge through the exhaust collector 60.

When pressure conditions in the pitot tube 58 and in the downstream side of the valve 52 exceed the pressure being evacuated from the crankcase, the valve will automatically close, thus assuring that the vacuum condition in the crankcase will be maintained throughout operation of the engine. The valve 56 will close only when the pressure in the pitot tube 58 exceeds the pressure at the outlet 48 of the pump.

As hereinbefore set forth, the novel crankcase vacuum system improves oil control, reduces oil consumption, and facilitates maintenance of a clean operating condition in the combustion chamber. In addition, oil ring tension can be reduced, which reduces engine friction, resulting in a higher power output and a cooler running engine. Furthermore, with the addition of the exhaust in the vacuum system, the capacity of the crankcase vacuum system is boosted or increased, thus enabling the system to handle higher concentrations or amounts of piston ring "blow by", or fluid leakage.

From the foregoing it will be apparent that the present invention provides a novel crankcase vacuum system wherein a vacuum is rapidly pulled or created within the crankcase upon initiation of engine operation, and maintained therein throughout the engine operation, thus reducing piston ring "blow by" or oil leakage around the piston rings which results in a cleaner condition for the combustion chamber and provides greater engine efficiency with less oil consumption.

Whereas the present invention has been described in particularly relation to the drawings attached hereto, it should be understood that other and further modifications, apart from those shown or suggested herein may be made within the spirit and scope of this invention.

What is claimed is:

1. A crankcase vacuum system for an engine having a fuel pump and an intake manifold and a crankcase, said vacuum system comprising check valve means disposed in communication with the intake manifold and having a normally closed position, means providing communication between the check valve and the fuel pump and crankcase, and means providing communication between the fuel pump and the crankcase, said check valve means being responsive to pressure differentials acting thereon for opening when pressure within the intake manifold is less than pressure within the crankcase for reducing the pressure within the crankcase and for closing when the pressure within the intake manifold is greater than the pressure within the crankcase for precluding passage of said increased pressure into the crankcase, and said fuel pump being in constant communication with the crankcase for cooperating with the closed position of the check valve means to maintain the reduced pressure condition within the crank case during operation of the engine.

2. A crankcase vacuum system as set forth in claim 1 and including means providing communication between the fuel pump and intake manifold and crankcase and an exhaust system.

3. A crankcase vacuum system as set forth in claim 1 wherein the check valve means is interposed in conduit means extending into communication with the intake manifold, and the means providing communication with between the fuel pump and the intake manifold includes a second conduit means extending from the check valve means into communication with a third conduit means, and said third conduit means provides said communication between the fuel pump and the crankcase.

4. A crankcase vacuum system as set forth in claim 1 wherein the means providing communication between the fuel pump and crankcase comprises closed circuit conduit means extending from the inlet port of the fuel pump to the outlet port thereof.

5. A crankcase vacuum system as set forth in claim 4 wherein an exhaust system is interposed in the closed circuit conduit means.

6. A crankcase vacuum system as set forth in claim 5 wherein check valve means is interposed in the closed circuit conduit means between the crankcase and the exhaust system.

7. A crankcase vacuum system as set forth in claim 6 wherein said check valve means includes a first check valve disposed downstream of the crankcase means, and a second check valve interposed between both the fuel pump and first check valve.

* * * * *